US005285891A

United States Patent [19]

Keip

[11] Patent Number: 5,285,891

[45] Date of Patent: Feb. 15, 1994

[54] CONVEYOR FOR ROTARY FILM WRAPPING APPARATUS

[75] Inventor: Charles P. Keip, Grandville, Mich.

[73] Assignee: Liberty Industries, Girard, Ohio

[21] Appl. No.: 891,743

[22] Filed: Jun. 1, 1992

[51] Int. Cl.[5] ..... B65G 15/10

[52] U.S. Cl. ..... 198/817; 53/588; 53/591

[58] Field of Search ..... 198/817; 53/591, 588, 53/580

[56] References Cited

U.S. PATENT DOCUMENTS

| | | | |
|---|---|---|---|
| 1,535,785 | 4/1925 | Luce | 198/817 |
| 1,983,492 | 12/1934 | Reed | 198/817 X |
| 2,962,152 | 11/1960 | Lathrop | 198/817 |
| 3,289,818 | 12/1966 | Kittredge | 198/840 X |
| 3,628,651 | 12/1971 | Wolzak | 198/817 X |
| 3,738,478 | 6/1973 | Tourtellotte | 198/394 |
| 3,978,979 | 9/1976 | Mezey | 198/817 X |
| 4,317,322 | 3/1982 | Lancaster et al. | 53/399 |
| 4,720,005 | 1/1988 | Beresinsky | 198/817 X |
| 4,979,358 | 12/1990 | Keip | 198/817 X |
| 5,027,579 | 7/1991 | Keip | 53/588 X |

*Primary Examiner*—Cheryl L. Gastineau
*Attorney, Agent, or Firm*—Harpman & Harpman

[57] ABSTRACT

An improvement in a conveyor for a rotary stretch film wrapping apparatus for wrapping a product in a plastic film, the rotary stretch wrapping apparatus includes a base frame, a rotary support structure, a roll of film mounted to the support structure, a film dispensing mechanism, a pre-stretching device, and a conveyor system for passing the product through the support structure. The improved conveyor system includes a pair of horizontally adjacent endless conveyors having one piece segmented lug belts adapted to prevent portions of the segments traveling the return path from hindering the product or the plastic wrap.

12 Claims, 8 Drawing Sheets

CONVEYOR FOR ROTARY FILM WRAPPING APPARATUS

BACKGROUND OF THE INVENTION

1. Technical Field

The present invention pertains to an improvement in a conveyor system for a rotary stretch wrapping apparatus for quick and efficiently providing a continuous wrap about a product. The packaging of products to be shipped in a wrapped stretch plastic film is becoming increasingly popular, stretch wrapping offers several advantages over the use of boxes, craft paper and other conventional packaging means. In particular, stretch wrapping provides a durable, water resistant, and inexpensive covering for the product. Moreover, a product may be wrapped with great speed and thereby increase the resultant through output.

One known stretch wrapping apparatus is disclosed in U.S. Pat. No. 4,317,322 to Lancaster et al entitled ROTATABLE FILM WRAPPING APPARATUS WITH WRAP CARRYING MECHANISM. Although such a machine will provide a continuous wrap of plastic film about a product, the machine is comprised of complex, inefficient, and unbalanced components. More specifically, the Lancaster patent '322 discloses a complex conveyor system for passing the product through the wrapping machine and an off balance rotary structure adapted to circumscribe the product.

In a rotary stretch wrapping machine, the plastic film is tightly wrapped about the product and the conveyor upon which it rests. An ordinary conveyor is therefore useless since engagement of the film with the return path fights against the forward moving product. To overcome this problem, Lancaster has developed a complex conveyor system comprised of superimposed belts and an array of pulleys. However, fabrication of such a system involves high manufacturing and maintenance costs.

In a rotary stretch wrapping operation, the wrapping mechanism is spun about the product by a rotary support structure. In Lancaster '322, the rolls of film are mounted in a cantilevered manner to a circular rotary structure which is rotatably driven to effect wrapping of the product. These rolls, however, are frequently quite heavy and therefore engender large moment forces in the rotary structure as it is rotated about the product. These forces create a substantial imbalance in the structure which not only will hasten bearing wear, but also may pose a safety hazard.

This improvement to a conveyor system for a rotary film wrapping apparatus is directed primarily to the belt construction which is used in the conveyor system, see for example applicant's own U.S. Pat. Nos. 4,979,358, 5,027,579, 3,738,478, 2,962,152, 4,720,005, 3,628,651 and 3,978,979.

In applicant's own U.S. Pat. Nos. ending in 358 and 579 multiple independent lugs are shown formed of resilient resin material are reinforced composite resin construction which are positioned in spaced side to side longitudinal alignment and secured to a link chain forming the multiple lug conveyor belt configuration.

In U.S. Pat. No. 3,738,478 a conveyor chain is disclosed in which a plurality of independent supporting plates are attached to a drive chain element.

In U.S. Pat. No. 2,962,152 a conveyor track support structure is shown in which a pair of spaced parallel endless chain conveyors are positioned so that they form a multiple side by side conveyor belt configuration within a guide track.

In U.S. Pat. No. 4,720,005 a material conveyor and distribution system is disclosed in which a pair of endless conveyor belts are positioned in an angular abutting relationship to form a V-shaped trough conveyor surface. A portion of the belt is unsupported so that it forms an opening or discharge area along the conveyor surface.

In U.S. Pat. No. 3,268,651 a device for tilting advancing containers is disclosed which utilizes a pair of spaced angularly inclined conveyor belts which form a product engagement path between opposing belt surfaces for tipping the product as it engages the belt area.

Finally, in U.S. Pat. No. 3,978,979 an apparatus for arranging, separating and positioning of items to be conveyed is disclosed which is characterized by two spaced parallel movable endless conveyor elements which provide for support and transfer of uniquely shaped products therebetween by engagement of the products on the belt's edge or oppositely disposed perimeter edge surfaces.

SUMMARY OF THE INVENTION

An improvement in a conveyor system for a rotary film wrapping apparatus of the present invention includes a pair of endless conveyors carried by vertical axles and positioned horizontally to one another in cooperatingly transport products to be wrapped. More specifically the conveyors are oriented such that the return paths are positioned between the two outer, forward carrying paths. The conveyors further include segmented portions which are expanded outwardly by cams when transversing forward carrying paths and contracted when transversing the return paths. In this way, the expanded outer segments hold the products above the segments of the return path as they are conveyed through the wrapping machine. Furthermore the expanded conveyor segments also engage and hold the wrapped film away from contracted return path segment so that the film can be moved without impeding the product being wrapped. This construction is much less complicated and more efficient than the conveyors of prior art in results and increased durability, reduced maintenance and ease of assembly.

DESCRIPTION OF THE PREFERRED EMBODIMENT

Figure 1:
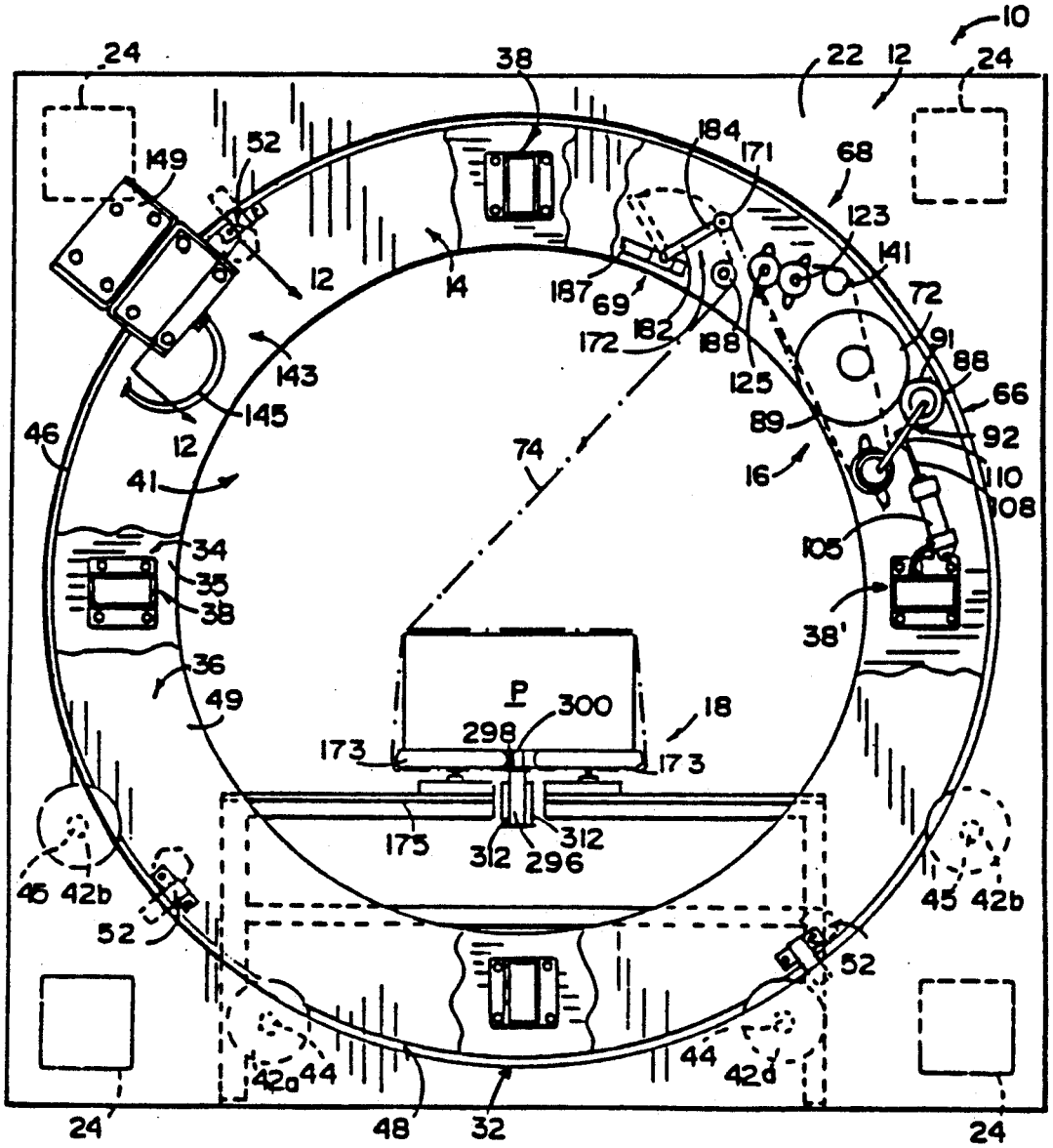
FIG. 1 is a front view of a rotary stretch wrapping apparatus of the present invention.

In the preferred embodiment, a rotary stretch wrapping apparatus 10 in accordance with the present invention includes a fixed base frame 12, a rotary cage or support structure 14, a wrapping assembly 16, and a conveyor system 18. These components cooperate with one another to effect the wrapping of a wide variety of products with a protective plastic film.

Figure 2:
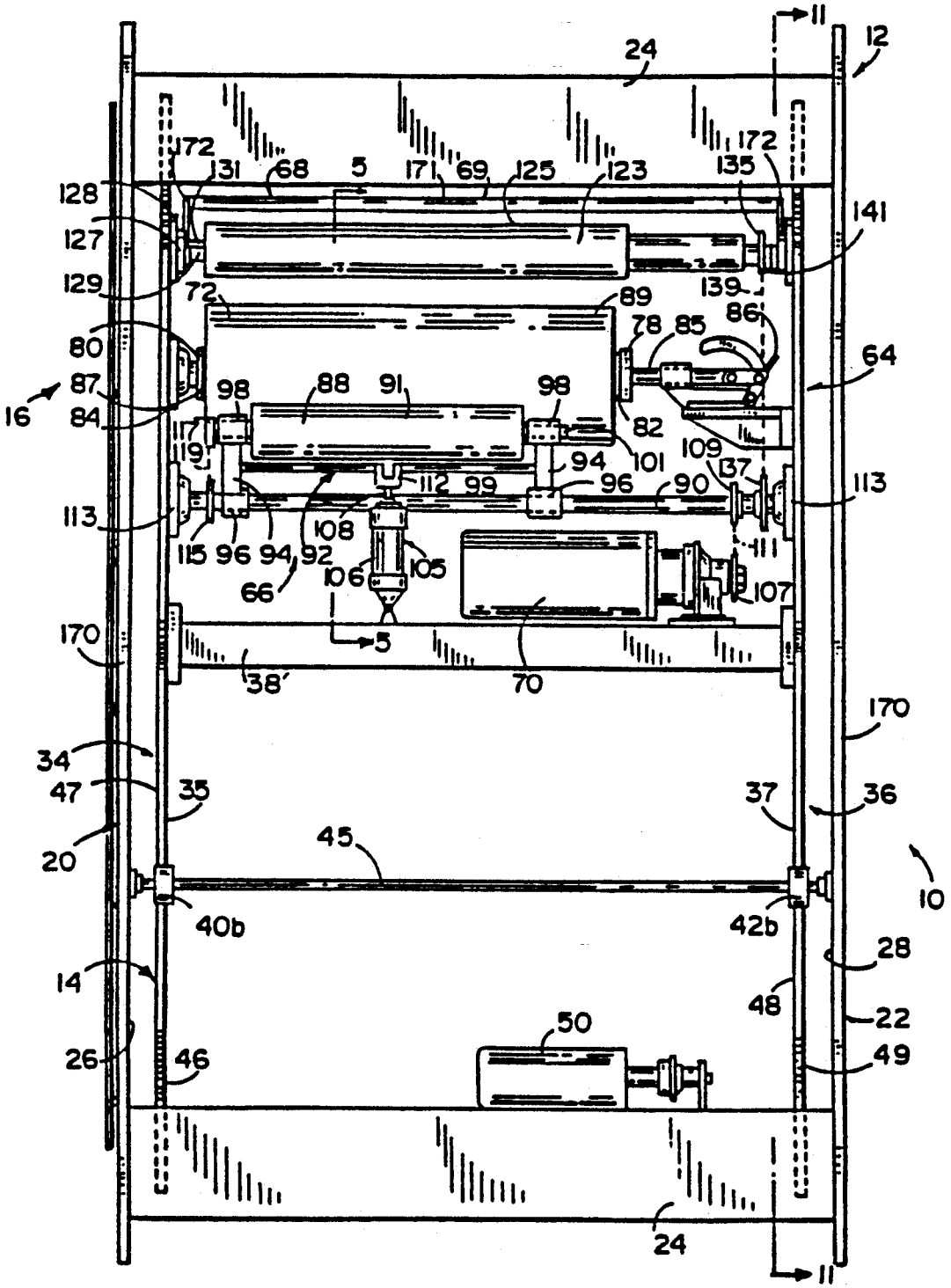
FIG. 2 is a side view of the apparatus.
Figure 3:
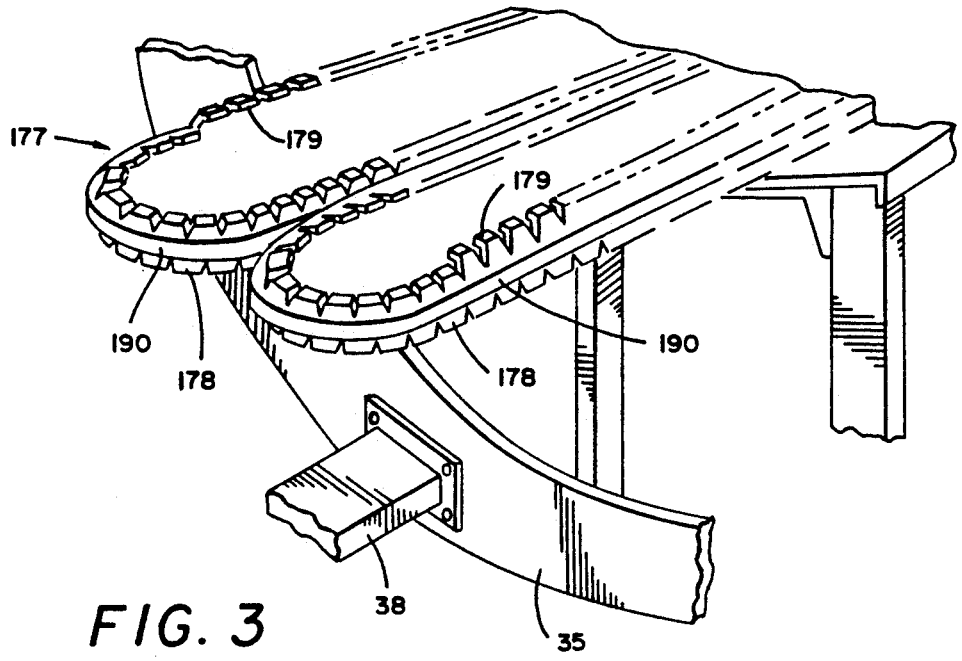
FIG. 3 is a fragmentary perspective view of the apparatus showing an improvement in the conveyor system of the present invention with the clamping assembly omitted for clarity.
Figure 4:
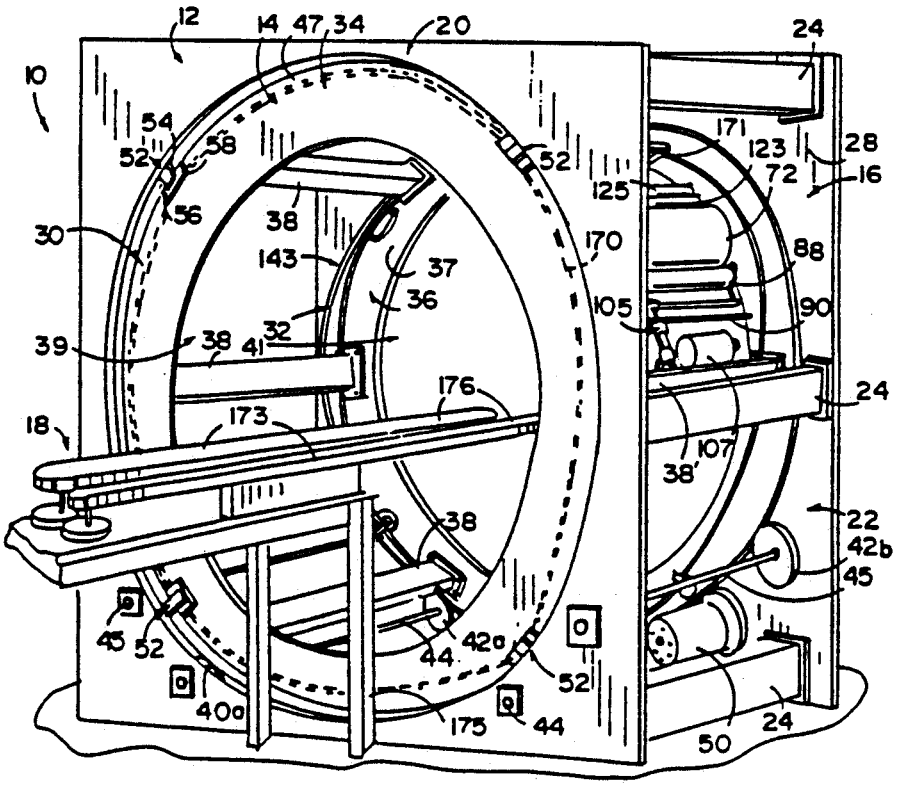
FIG. 4 is a rear fragmentary view of the apparatus with the clamping assembly omitted.

Base frame 12 includes a pair of upstanding large metal sheets 20, 22 and a plurality of horizontal interconnecting beams 24, see FIGS. 1,2 and 4 of the drawings. Beams 24 are bolted or otherwise secured to the inner faces 26,28 of sheets 20,22 along their periphery, to provide a large stable base with which to effect the wrapping operation. Each sheet 20,22 defines a large central opening 30,32 through which the products to be wrapped are passed.

Rotary cage 14 is rotatably mounted to base frame 12 to achieve wrapping of the products as discussed below. Cage 14 is comprised of a framework including a pair of annular rings 34,36 and a plurality of interconnecting brace members 38, see FIGS. 1 and 4 of the drawings. Braces 38 are bolted or otherwise fixedly secured to the inner faces 35,37 of rings 34,36 to form a uniform and stable rotary support structure. Rings 34,36 further define a pair of aligned opening 39,41 positioned concentrically within openings 30,32 of base frame 12, to permit passage of the products. The cage 14 is mounted for rotation about a substantially horizontal axis by a plurality of rollers 40,42 journaled between sheets 20,22, FIGS. 1 and 2 and 4 and 11 of the drawings. Preferably eight support rollers are provided along the lower portions of the base frame 12 to the support cage 14. In particular, the rollers 40 and 42 are paired upon rotatable shafts 44 and 45 such that four rollers 40 engage the outer peripheral edge 46 of the forward ring 34 and the four rollers 42 engage the peripheral edge 48 of the rearward ring 36. In the most preferred embodiment, the four lower most rollers 40A and 42 are driven by an electric motor 50 and a conventional chain drive (not shown) to rotate cage 14. As a safety measure, motor 50 is preferably a fail safe brake motor which will stop the rotation of the cage 14 if the power is cut off. The four uppermost rollers 40B, 42B and idler roller provide for support of the cage. Of course, additional support rollers could be provided about the entire periphery of the rings 34 and 36 if needed or desired. Generally, the size and weight of the cage 14 precludes it from lifting upwardly when rotated.

To further support and position the cage 14, each sheet 20, and 22 includes a plurality of lateral stops 52 positioned around openings 30, 32 in FIGS. 1 and 4. Stops 52 slidingly engage the outer surfaces 47, 49 of rings 34 and 36 to prevent the cage from moving longitudinally. Each stop 52 includes a mounting tab 54 affixed to the base frame 12 and a shoe 56 having a low friction end surface 58 pressed against the cage rings 34 and 36.

Wrapping assembly 16 includes a number of components secured to the cage 14 for rotation therewith about the products, see FIGS. 1,2,4 and 5 of the drawings. Additionally, a cooperating counter weight (not shown) is preferably secured to cage 14 to offset the weight of the wrapping assembly 16 and thereby achieve greater balance. In short, the wrapping assembly 16 functions to mount the rolls of plastic wrapping film, dispense the film as the cage is rotated, and affect pre-stretching the film before it is wrapped about the product. Wrapping assembly 16 includes a film mounting structure 64, a rolling drive assembly 66, a film pre-stretching arrangement 68, dancer roll assembly 69 and an electric motor 70.

Film mounting structure 64 is adapted to releasably mount a roll of the plastic film 72 for rotation about a substantially horizontal axis, see FIG. 2 of the drawings. The film 74 is preferably a conventional plastic wrapping film (e.g. polyethene) which as one commercially available from Mobil Oil Corporation or Presto Corp. Of course other suitable materials could be used. As is conventional, the film 74 is rolled upon a core 76 for easy storage handling and use. Film mounting structures 64 includes a pair of rotatable hubs 78, 80 each having a head which is received within the hollow core 76 and a shoulder abutment 82, 87 which flushingly engages against the ends thereof. To effect installation and release of the rolls, one hub 78 is longitudinally movable towards and away from core 76. More specifically, hub 80 is journaled for rotation to ring 34 by a support 84 which maintains the hub in a fixed longitudinal position. The other hub 78 is journaled for rotation by a longitudinally movable support 85 secured to ring 36 by a toggle or other type of clamp 86. Alternately, both hubs 78,80 could be mounted for longitudinal movement.

Figure 5:
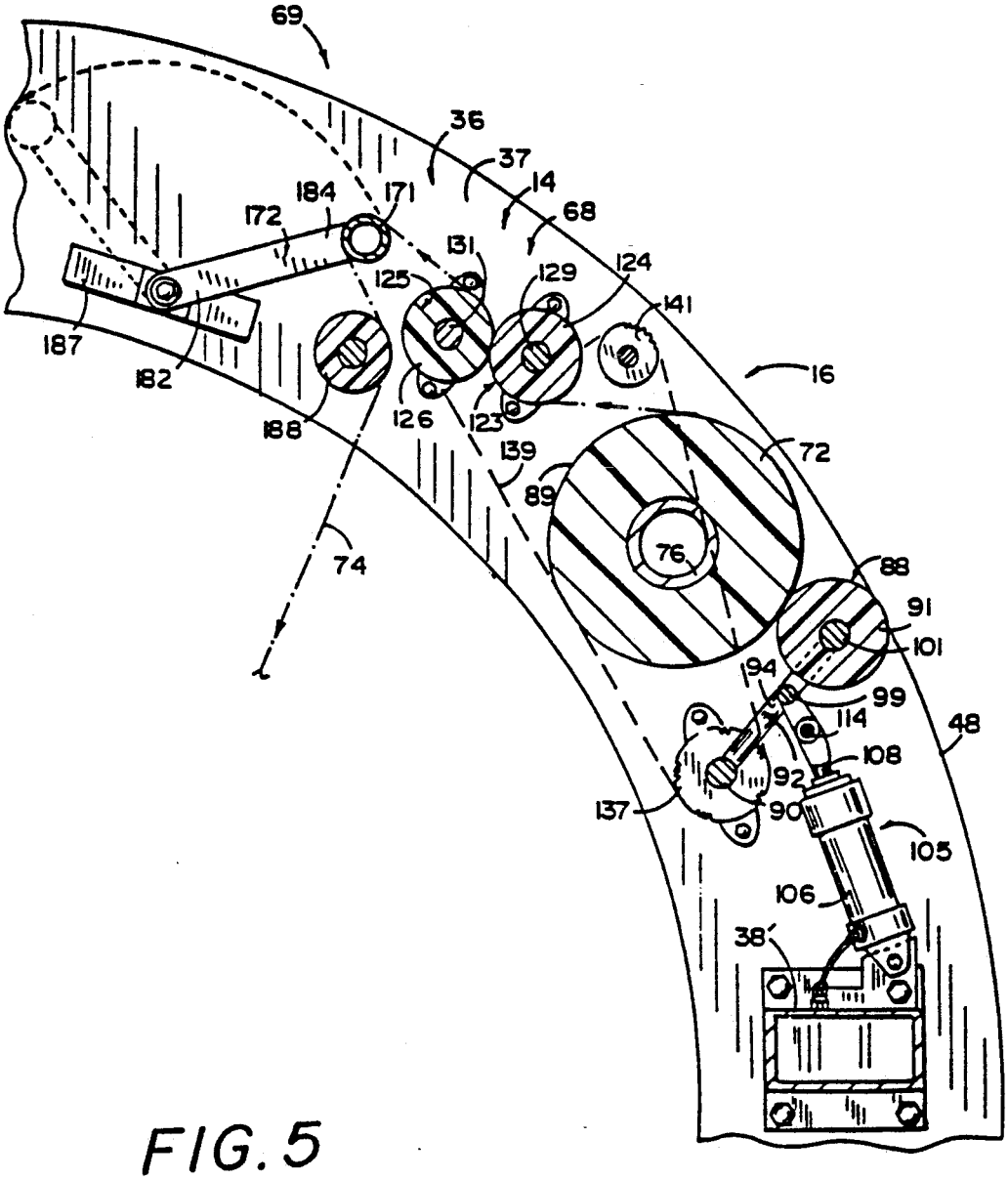
FIG. 5 is a cross-sectional view taken on lines 5—5 of FIG. 2 with an electric motor omitted for clarity.

Film 74 is dispensed from roll 72 by a roll driving assembly 66, see FIGS. 1,2 and 5. Roll driving assembly 66 includes a driving roller 88 adapted to engage the outer periphery 89 of the roll of film 72 at all times during the wrapping operation. Driving roller 88 preferably includes a resilient outer pad 91 (preferably composed of urethane) affixedly secured upon a central driving mounting pin 101. As can be readily appreciated this arrangement will dispense film 74 at a substantially constant rate irrespective of the diameter of the roll 72.

Driving roller 88 is pivotally mounted for arcuate movement about a drive shaft 90 secured between rings 34,36. More specifically, an H-shaped connector 92 includes a pair of mounting segments 94 having bearings 96,98 at each end thereof and an interconnecting rod 99. Bearings 96 function to mount segments 94 on the drive shaft 90 so that connector 92 is neither effected by nor inhibits the shaft's rotation. Bearings 98 rotatably secure segments 94 to the central mounting pin 101 of the driving rollers 88. A rod 99 is fixedly attached to and interconnects segments 94 to facilitate the coupling of a biasing cylinder 105 to rollers 88. Biasing cylinder 105 provides a constant force which presses driving roller 88 against the outer surface 89 of the roll 72 so that no significant slippage occurs therebetween to disrupt the wrapping operation. Biasing cylinder 105 is a pneumatic cylinder having a casing 106, piston (not shown) movably positioned therein and an extending piston rod 108. The distal end 110 of piston rod 108 is pivotally secured to a connecting rod 99 by a bifurcated bracket 112 and a cooperating bolt 114. Casing 106 is likewise pivotally secured to an adjacent brace 38' so that cylinder 105 can move to accommodate the variable extension of the rod 108 as the film 74 is dispensed.

Biasing cylinder 105 is supplied with a substantially constant pressure of air so that roller 88 engages roll 72 with sufficient pressure throughout the entire dispensing of the film 74. The air pressure for cylinder 105 is maintained through a unique supply system 143, see FIGS. 4 and 10–12 of the drawings. Supply system 143 includes a central unit (not shown) which is of a conventional design and includes a pump, filter, lubricator and regulator for supplying, controlling, and maintaining a constant air pressure source through supply hose 145. Supply hose 145 is fluidly coupled to an air shoe 147 adapted to transfer pressurized air to cage 14.

Figure 12:
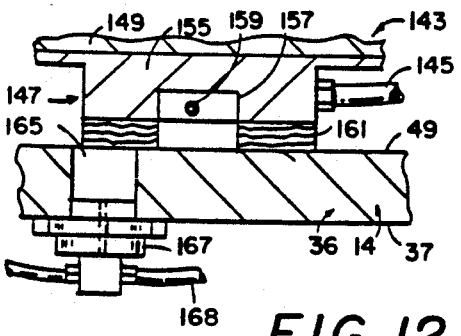
FIG. 12 is a cross-sectional view taken on lines 12—12 of FIG. 1.

The air shoe 147 includes a body 155 secured to the underside of a support structure 149 via bolting or the like, and a sealing ring 161 secured to body 151 via an adhesive or other securing means to form an integral air shoe unit, see FIG. 12. Air shoe unit 147 defines a radial bore 159 and a cavity 157 extending at right angles thereto. Cavity 157 opens at one end through an end face 162 of ring 161 and is fluidly coupled at its opposite end to a bore 159. The bore 159 in turn is coupled to a supply hose 145 so that the supply of pressurized air is passed through air shoe 147. The air shoe 147 is positioned such that the end face 162 is firmly pressed against the outer face 49 of ring 36 to form an airtight seal therebetween. Preferably, sealing ring 161 is composed of a conventional V-packing material, although other materials having low frictional characteristics and sealing quantities could be used. The pressurized air passed into cavity 157 is transferred to an air routing system 169 provided on the rotating cage 14.

Routing system 169 includes a plurality of spaced holes 165 defined in and extending completely through the ring 36. A check valve unit 167 is securedly mounted along the inner surface 37 of the ring 36 at each hole 165. As ring 36 rotates during the wrapping operation, holes 165 will be sequentially passed across cavity 157 of the air shoe 147 and thereby given a shot of pressurized air. The air then passes through check valve 167 and into conduit 168 supported by ring 36.

Figure 10:
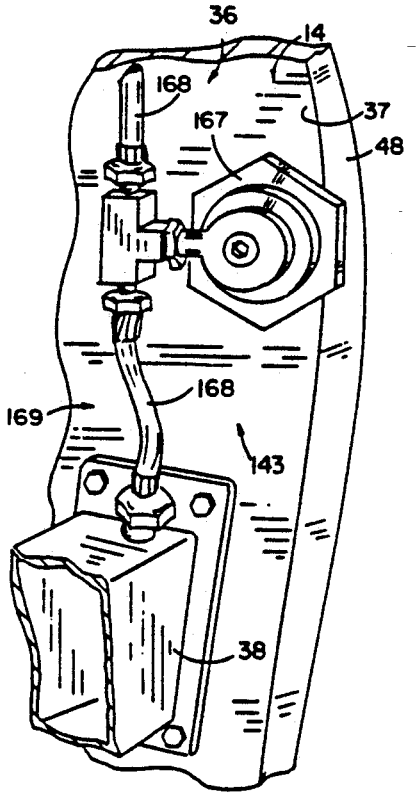
FIG. 10 is a fragmentary perspective view of a portion of the air pressure system of the apparatus.
Figure 13:
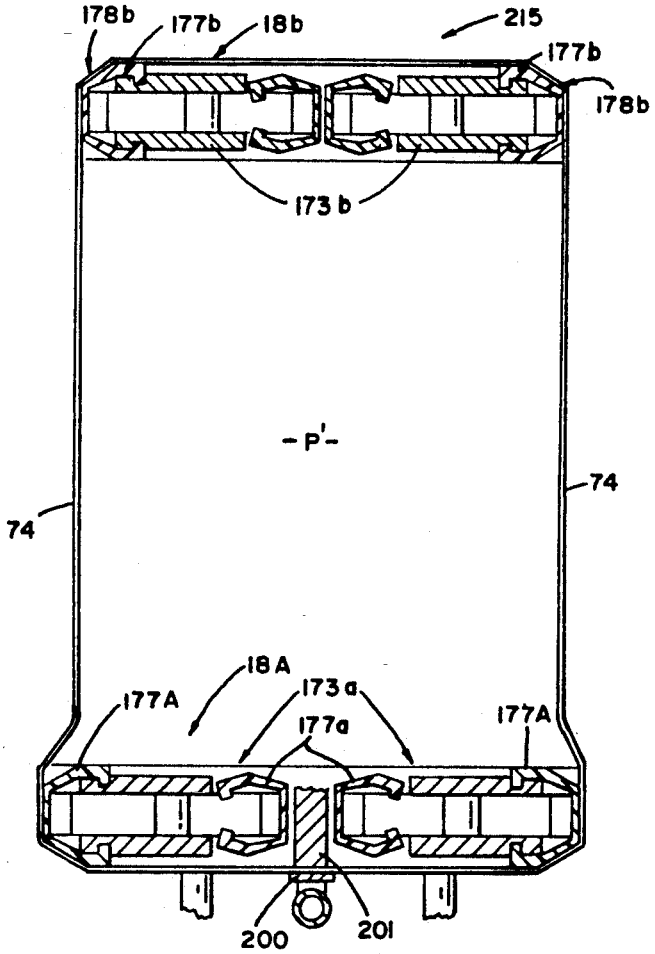
FIG. 13 is a sectional view of a second embodiment of the conveyor system of the apparatus.
Figure 11:
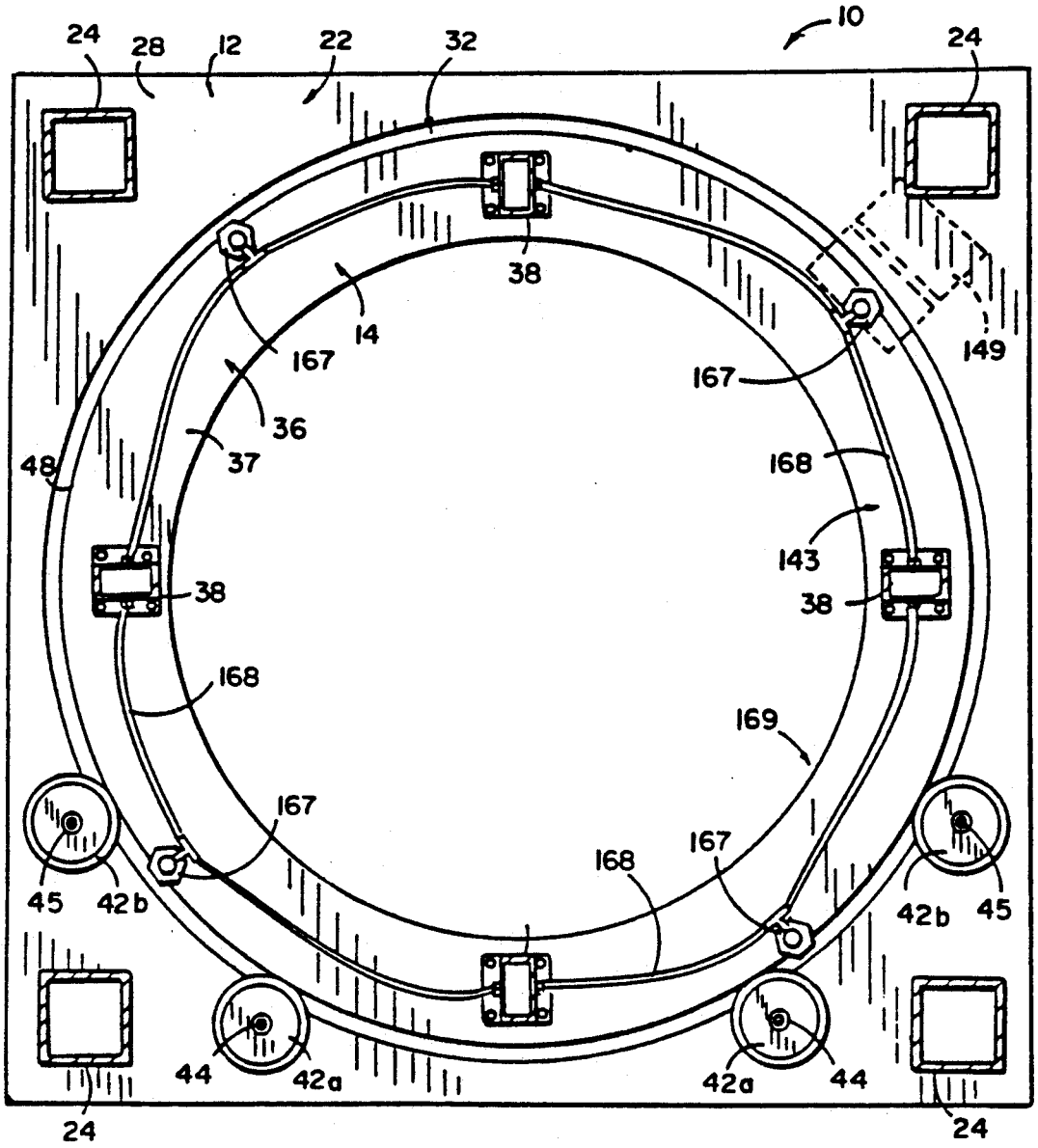
FIG. 11 is a cross-sectional view taken along lines 11—11 in FIG. 2 with the wrapping assembly omitted for clarity.

Each of the braces 38 has a hollow airtight construction, see FIGS. 10 and 11 of the drawings and are interconnected with one another and with check valves 167 by a conduit 168, see FIGS. 4 and 10–12 of the drawings. Hence the pressurized air is passed through check valves 167 and travels via conduit 168 to braces 38. As seen in FIG. 5 biasing cylinder 105 is then fluidly coupled with the brace 38' to which it is secured. In this way the fluid pressure remains substantially the same despite the expansion of the cylinder 105 and any loss of air due to leaks in the system.

Driving roller 88 is preferably driven by an electric DC motor 70 through a series of cam chains and sprockets, see FIG. 2 of the drawings, of course the other driving arrangements could be used. Motor 70 is affixedly attached to one of the braces 38 of the cage 14 for rotation therewith. In the preferred embodiment, the motor 70 is mounted to the same brace 38' as biasing cylinder 105, although such mounting is not necessary. The power for the motor 70 is preferably supplied through a conventional arrangement of slip rings 170 secured to the outer surface of the sheet 22 about the opening 32. Slip rings 170 are well known tracks such as commonly are used to power overhead cranes and the like positioned in a circular manner about the opening 32. Annular ring 36 of the cage 14 includes common mating elements (not shown) to electrically couple to the tracks. The motor 70 includes a motor sprocket 107 which provides the necessary output to dispense and pre-stretch the film.

Drive shaft 90 is journaled for rotation between the rings 34 and 36 by mounts 113. Drive shaft 90 functions to transmit the output power of the motor 70 to the roll driving and pre-stretching components. More practically, power sprocket 109 is keyed to drive shaft 90 opposite motor sprocket 107. The two sprockets 107 and 109 are operably coupled by chain 111 to effect a driving rotation of the drive shaft 90. A first driving sprocket 115 is also keyed to drive shaft 90 for concurrent rotation therewith. Opposite sprocket 115 and coupled therewith by chain 119 is a drive roller sprocket 117 keyed to mounting pin 101. Driving roller sprocket 117 then effects driving rotation of roller 88 upon activation of the motor 70. The mounting of the drive roller 88 directly on the drive shaft 90 also permits the driving roller sprocket 117 to move arcuately about first driving sprocket 115 without disrupting the coupling therebetween.

Once film 74 is dispensed from roll 72 by driving roller 88 it passes through a pair of pre-stretching pinch rollers 123 and 125, see FIGS. 1–2 and 5. Pinch rollers 123 and 125 each include a resilient pad 124 and 126 fixedly mounted on axis 129 and 131 which are journaled between rings 34,36 by mounts 127, 128. Each axle 129, 131 includes an axle sprocket 133, 135 which is aligned to couple with a second driving sprocket 137 (keyed to drive shaft 90) by chain 139. This driving arrangement further includes an idler sprocket 141 rotatable attached to the inner surface 37 of the ring 36. Idler sprocket 141 facilitates the proper routing of the chain 139 to obtain the necessary opposite rotation of pinch rollers 123 and 125 as best seen in FIGS. 1 and 5, chain 139 follows a serpentine path outwardly of the idler sprocket 141 inwardly of the axle sprocket 133 and outwardly of the axle sprocket 135. This arrangement enables pinch rollers 123 and 125 to cooperate with one another in moving the film 74 therebetween. Axle sprockets 133, 135 are of equal size so that the pinch rollers rotate at the same rate. The size of the first and second drive sprockets 115 and 137, the driving roller sprockets 117 and the axle sprockets 133,134, the pinch rollers 123, 125 and the driving roller 88 are all selected such that the pinch rollers 123,125 operate to pass the film 74 therethrough at a quicker rate than driving roller 88 dispenses the film 74 from roll 72. Therefore the film 74 is stretched to a pre-determined amount prior to being wrapped about the product. Typically, the film is elongated approximately 50% and it will be obvious that the speed of the pinch rollers and driving roller are also coordinated with the rotational rate of the cage 14.

After the film passes through the pinch rollers 123,125 it is directed through dance roller assembly 69 which includes a dancer roller 171 pivotally mounted between rings 34 and 36 by a pair of pivot arms 172. The dance roller preferably a tubular aluminum member so as to be lightweight and yet still sufficiently rigid. Each pivot arm 172 includes a mounted end 182 and a free end 184 wherein the mounted end 182 is pivotally attached for movements about a substantially horizontal axis 186 and the free end rotatably mounted roller 171. The dancer roller assembly 69 further includes a guide roller 188 which is secured between rings 34 and 36 to guide the film around the rotary actuator 187.

Dancer roller assembly 69 is used to partially compensate for irregularities in the shape of the product, for example referring to FIG. 1 it can readily be seen that the lower surface of the product P is closer to the rings 34 and 36 than at its upper surface. Hence wrapping assembly 16 will tend to dispense a greater amount of film when it traverses about the product than it will when it traverses below the product. To this inconsistency, the dancer roller is adapted to take up the slack when too much film is dispensed and permit extra film to be used when too little film is being dispensed.

The products to be wrapped are passed through the cage 14 on a improved conveyor system 18, see FIGS. 1,3,4,6 and 7 of the drawings. The improved conveyor system 18 generally comprises two horizontally adjacent endless conveyors 173. The conveyors 173 are mounted on a support stand 175 in a cantilevered manner such that their free ends 176 extend well within and substantially through the cage 14. In a rotary stretch wrapping process, the conveyors 173 along with the product are tightly wrapped with plastic film. To facilitate effective operations of the device, portions of the conveyor 173 contacted by the plastic film 74 must be moving in the same direction as the product to be wrapped; otherwise the conveyors and the product will be fighting against one another and a proper wrap will not be achieved.

In the present invention, the two conveyors 173 are substantially arranged about vertical axis' in a horizontal plane such that the forward carrying path portion 178 of the conveyors are positioned along the outer paths and the rearward returning path portions 180 of the conveyors oppose one another along their interior path.

Each of the conveyors 173 includes a continuous multiple lug belt 177 having oppositely disposed independently movable arm segments 179 and 181 formed thereon. To obviate the resistance generated by the return path, the lug belt 177 is sequentially expanded at each arm segment 179 and 181 along the forward supporting paths so that along the top of the conveyors, the product to be wrapped is supported above the return patent and along the bottom of the conveyors, the plastic film 74 wrapped around the conveyors is held off the return path. Each of the continuous lug belts 177 is formed from a one-piece resilient plastic material having the required deflection and strength properties bonded to a continuous drive belt 189 such as those manufactured under the trade name Gates Poly Chain* which is a registered trademark of The Gates Rubber Company.

Figure 7:
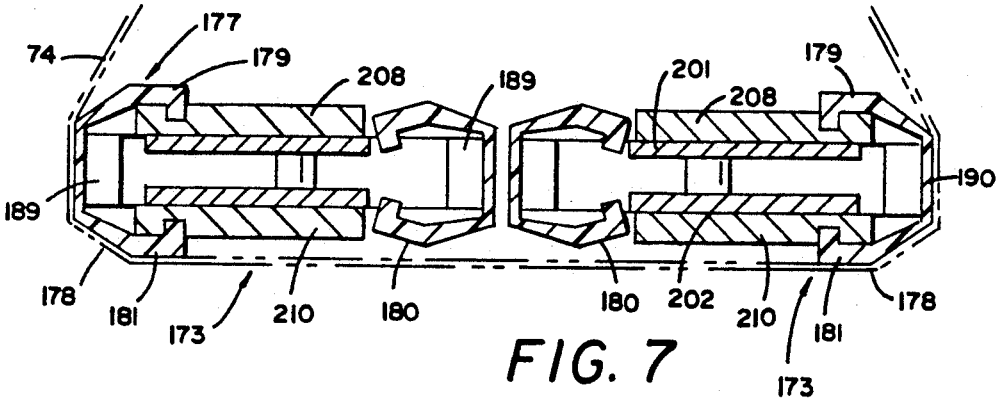
FIG. 7 is a cross-sectional view taken along lines 7—7 in FIG. 3.
Figure 6:
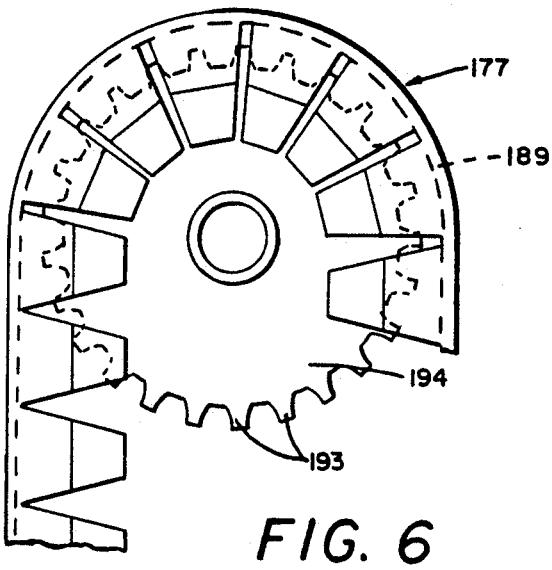
FIG. 6 is a top fragmentary view of a portion of one end of one of the conveyors.
Figure 8:
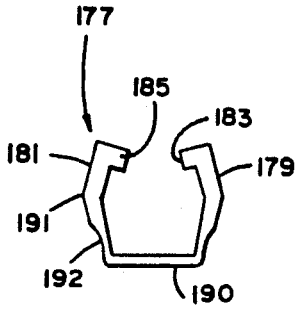
FIG. 8 is a sectional view on lines 8—8 of FIG. 9.
Figure 9:
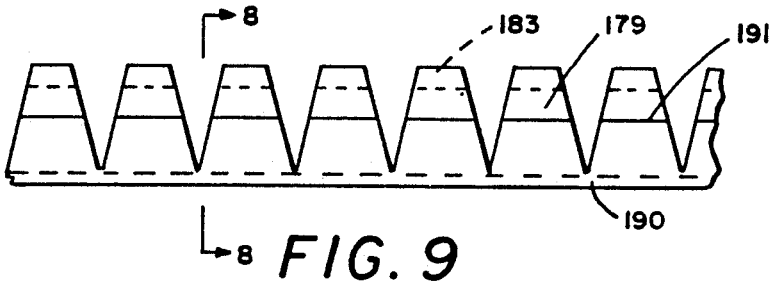
FIG. 9 is a fragmentary top plan view of a portion of the lug belt.
Figure 14:
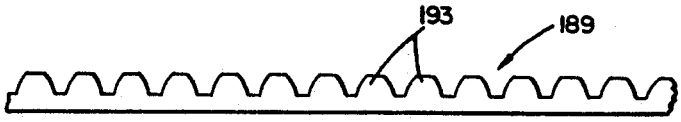
FIG. 14 is a fragmentary top plan view of a portion of the drive belt separated from the lug belt for clarity.

Each pair of arm segments 179 and 181 has a compound angular inclination extending from a common continuous spacing element 190 best seen in FIGS. 7 and 8 of the drawings. The angular inclination indicated at 191 of the effacing arm segments 179 and 181 is such that respective distal ends 183 and 185 of the arm segments are directed towards one another at an inclination of approximately 30 degrees. Each of said arm segments is characterized by a decreasing transverse dimension extending inwardly from said angular inclination at 191 with a further narrowing at 192 abutting said spacing element 190 which is integral with the segmented arms 179 and 181 as hereinbefore described.

Positioned between these segmented arms 179 and 181 and bonded to the common continuous spacing band 190 is the continuous drive belt 189 having a plurality of longitudinally spaced engagement teeth 193 facing outwardly therefrom. A conveyor sprocket 194 is rotatably mounted at each end of the two conveyors 173 for engagement with the drive belt 189. Drive sprockets 195 positioned above the support stand 175 are driven by a conventional electric motor (not shown).

To facilitate the expansion of the arm segments 179 and 181 as they travel along the forward carrying paths 178, a pair of elongated cam 208, 210 are affixedly attached to the upper and lower conveyor plates 201 and 202 of each conveyor 173. These cams 208 and 210 push the segmented arms 179 and 181 outwardly along the forward paths such that they expand beyond the arms of the lug belt 177 traveling along the return paths 180 as shown in FIG. 7 of the drawings. These cams 208 and 210 extend the entire length of the conveyors and are tapered at each end to provide an easy and gradual expansion and contraction of the segmented arms 179 and 181 on the continuous lug belt 177.

In an alternative embodiment 215 a pair of spaced apart vertically aligned conveyor systems **18*a* and 18*b* are provided to lend additional support to a particularly tall or off balance product P'. In this arrangement the apparatus operates in the same manner as discussed above except that the product is fed and sandwiched between the lower conveyor system 18*a* and the upper conveyor system 18*b*. The conveyor systems 18*a* and *b* are identical to the conveyor systems 18 described above with the possible exception of the central clamping jaw may be eliminated from the top conveyor system. The plastic film 74 is wrapped around both conveyor systems 18*a* and *b* and engages the segmented arms 179 and 181 of the continuous lug belt 177 traveling the four forward path positions, 178*a* and 178*b* of the conveyors 173*a* and 173*b***. Further the products may be sequentially fed and separated downstream by a cutter or may be individually wrapped as needed.

To begin the wrapping operation, the leading end of the film 74 must be held in place until one or two subsequent wraps overlap to hold it in place. In this example, the leading end of the film 74 is clamped into place between a movable jaw 200 and an elongated fixed jaw 201 mounted between the two horizontal conveyors **173*a*** as hereinbefore described.

Figure 15:
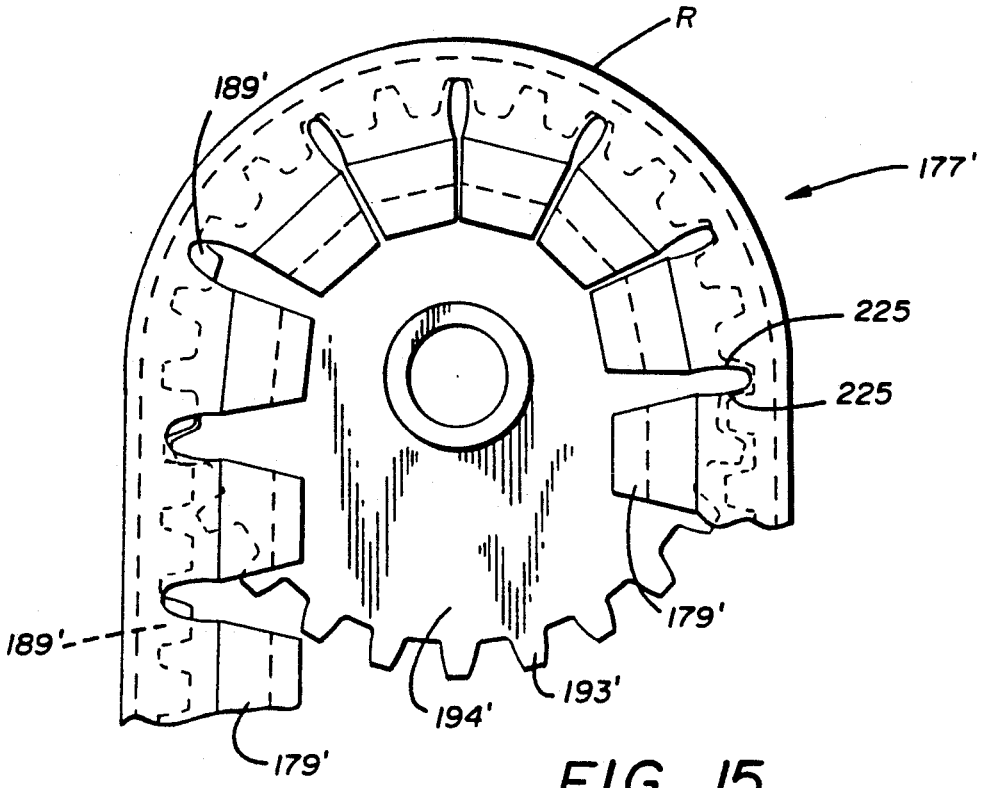
FIG. 15 is a top fragmentary view of a portion of one end of one of the conveyors showing an alternate lug belt configuration.
Figure 16:
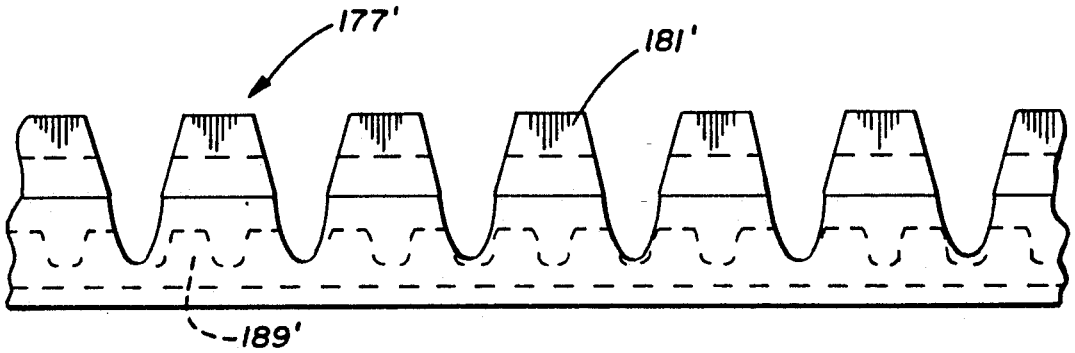
FIG. 16 is a fragmentary top plan view of a portion of an alternate lug belt configuration.

Referring now to FIGS. 15 and 16 of the drawings, an alternate form of the lug belt 177 can be seen indicated as a lug belt 177' having segmented arms 179' and 181' and an integral continuous drive belt 189'. The lug belt 177' is engagable around a conveyor sprocket 194' having spaced engagement teeth 193' the same as hereinbefore described preferred embodiment.

The lug belt 177' is characterized by pairs of opposing adjustment notches 225 on each of said segments 179' and 181'. As seen in FIG. 15 of the drawings in certain applications that require the lug belt 177' to pass around an extremely tight return radius R such as would be needed in handling very small packages (not shown). The preferred embodiment lug belt 177 would tend to bind intermittently raising the arm segments 179 and 181 due to lack of adjacent arm segment clearance. In the alternate form of the lug belt 177' the opposing notches 225 provide the additional clearance required without effecting the overall performance of the lug belt 177'.

In use, when beginning a new roll of film, the film 74 is manually fed beneath the conveyor with the movable jaw in its lower released position (not shown) wherein the jaw is retracted beneath the support stand 175. Once the film is positioned, the movable jaw 200 is actuated by the fluid cylinder means (not shown) and moved upwardly engaging the fixed jaw 201. The cage 14 is then rotated once or twice about the product P to overlap the leading end of the film 74 clamped between the jaws 200 and 201 as hereinbefore described. Once the leading end of the film has been overlapped with the subsequent film strips, the fluid cylinders (not shown) is reversed moving the movable jaw 200 downwardly to release the film from its grip. Thereafter the operation can be continued so that the product is spirally wrapped with film at the end of the wrapping sequence, the movable jaw 200 is re-engaged against the fixed jaw 201 gripping the trailing end of the film 74 therebetween. The film may then be severed and the wrapped product removed for shipment. Conventional sensors (not shown) coupled to a CPU (not shown) may be used to automate the above process.

Once the product has been positioned in the wrapping aperture, it rests upon the respective conveyors 173 moving along the forward paths 178. The product P if it is the first product to be wrapped is advanced until its front end edge is substantially aligned with the forward edge of the film 74. At this point the film 74 is clamped. The cage 14 is then rotated once or twice provided a plurality of overlapping strips which will tightly hold the leading end in place. Thereafter the removable jaw 200 is retracted to release the film 74 and the conveyors 173 are again actuated such that the product will be completed wrapped in a spiral wrap of film. Due to the tension on the film, the overlying strips will clamp down and hold the leading end in place after the removable jaw 200 is released.

Subsequently, a series of products may follow in a continual manner without stopping conveyors 173 or cage 14. These products are then separated by conventional cutting apparatus downstream from the apparatus 10. The film 74 is wrapped relatively tight about the product P and the conveyors 173 such that it will tend to contract towards the product when the product is fed off the feed end 176 of the conveyor 173. The gap provided between the conveyors 173 and the downstream conveyor (not shown) will permit this contraction to take place so that the film is easily fed onto the downstream conveyor. As time progresses the film will tend to contract further against the product to provide an even tighter wrap.

The apparatus can also be used to individually wrap products by using clamping assembly hereinbefore described after each product has been wrapped.

The above description is that of the preferred embodiment and various changes and modifications may be made therein without departing from the spirit of the invention as set forth in the appending claims.

What I claim is:

1. An improvement in a conveyor system for use in a wrapping apparatus comprises at least two endless conveyors positioned horizontally adjacent to one another, each conveyor having a path loop including a forward moving path portion for carrying an article and a rearward moving path portion, said forward and rearward path portions being oriented in a substantially horizontal plane, each conveyor further including a one piece segmented continuous lug belt arranged about the conveyors, said segmented continuous lug belt comprises a plurality of oppositely disposed arm segments extending from and integral with a common continuous spacing band, a continuous drive belt formed on said spacing band, each of said conveyors further including means for expanding said arm segments on the forward moving path portion in a direction perpendicular to the direction of movement to raise the article above the rearward moving path portion and for contracting said lugs as they traverse said rearward moving path portion.

2. A wrapping apparatus as defined in claim 1 in which said conveyors are positioned adjacent one another such that said rearward path portions are positioned between said forward path portions.

3. A wrapping apparatus as defined in claim 1 in which each of said conveyors further include cam means positioned along said forward path portions for expanding said lugs as they traverse said forward path portions.

4. A wrapping apparatus as defined in claim 1 in which each of said segment arms includes a distal face, wherein said distal faces are adapted to engage a portion of the article to be wrapped when traversing said forward path portions and be directed to face towards the segmented arms traversing one of the forward path portions when traversing in the rearward path portions.

5. The conveyor system as defined in claim 1 wherein said continuous drive belt and said spacing band are of continuous reinforced poly-resin composite construction, having multiple longitudinally spaced engagement teeth thereof.

6. An improvement in a conveyor system comprising two endless conveyors horizontally position adjacent to one another, each defining a continuous loop movable about a plurality of substantially vertical axis, each conveyor further including a one piece segmented continuous lug belt about the entire conveyor, a plurality of longitudinally spaced arm segment pairs extending from and integral with said continuous lug belt, said arm segments in spaced vertical relation to one another defining parallel horizontal path loops on each conveyor, means for expanding said arm segment pairs within a forward path loop moving portion, means for contracting said arm segment pairs on rearward moving path portions of said conveyors positioned in parallel horizontal plane to one another between said forward moving path loop portions.

7. An improvement in a conveyor system as defined by claim 6 wherein said means for expanding said arm spaced pairs along a forward moving path portion comprises cam means.

8. The improvement in a conveying system as defined by claim 6 wherein said segmented continuous lug belt includes a plurality of longitudinally spaced engagement teeth in oppositely disposed relation to said arm segment pairs, means for driving said lug belt on each of said conveyors.

9. An improvement in a conveyor system for use in a wrapping apparatus comprising at least two endless conveyors positioned horizontally adjacent to one another, each conveyor having a path loop including a forward moving path portion for carrying an article and a rearward moving path portion, said forward and rearward path portions being oriented in a substantially horizontal plane, each conveyor further including a one piece continuous lug belt arranged about the conveyors, said continuous lug belt comprises a plurality of oppositely disposed arm segments extending from and integral with a common continuous spacing band, said oppositely disposed arm segments having pairs of opposing adjustment notches in each of said respective arm segments defining an area of increased planar spacing therebetween, a continuous drive belt formed on said spacing band, each of said conveyors further including means for extending said arm segments on the forward moving path portion in a direction perpendicular to the direction of movement to raise the article above the rearward moving path portion and for contracting said arm segments as they traverse said rearward moving path portion.

10. A wrapping apparatus as defined in claim 9 in which said conveyors are aligned in parallel spaced planar relation to one another such that said rearward path portions are positioned between said forward path portions.

11. A wrapping apparatus as defined in claim 9 in which each of said conveyors further include cam means positioned along said forward path portions for extending said arm segments as they traverse said forward path portions.

12. A wrapping apparatus as defined in claim 9 in which each of said segmented arms include a distal face wherein said distal faces are adapted to engage a portion of the article to be wrapped when traversing said forward path portions and to be directed to face forward towards the segment arms traversing one of the forward path portions when traversing rearward path portions.

* * * * *